United States Patent [19]

Heller

[11] Patent Number: 4,700,477

[45] Date of Patent: Oct. 20, 1987

[54] EYEBROW TRIMMER

[76] Inventor: Ava Heller, 2929 Bonita St., Fort Myers, Fla. 33901

[21] Appl. No.: 769,087

[22] Filed: Aug. 26, 1985

[51] Int. Cl.[4] ..... B26B 21/08

[52] U.S. Cl. ..... 30/51; 30/27; 30/77

[58] Field of Search ..... 30/51, 77, 83, 73, 346.55, 30/26, 27, 59–61, 32

[56] References Cited

U.S. PATENT DOCUMENTS 2,300,794 11/1942 Martin ..... 30/83 X 2,983,045 5/1961 Diatikar ..... 30/73 X

*Primary Examiner*—Douglas D. Watts

*Attorney, Agent, or Firm*—Alfred E. Wilson

[57] ABSTRACT

A throw away razor type eyebrow trimmer having a narrow straight cutting surface has front and rear guards to reduce the danger of cutting the skin with the sharp edge of a razor blade. The guards pull the skin tight between the guards to render the trimming more manageable and precise. The eyebrow trimmer consists of three basic elements, (1) the razor blade, (2) the front safety head guard for the razor, and (3) the rear safety head guard. In use, the front safety head guard depresses and stretches the skin between it and the rear safety head guard which rides above the razor blade thus facilitates easier and better removal of hair. The eyebrow trimmer is mounted at a comfortable operating angle on a handle having a textured grip for easy holding and manipulation of the eyebrow trimmer, and by using a mirror the party using the trimmer can have a clear view of the eyebrow curving and trimming operation as it progresses.

2 Claims, 7 Drawing Figures

EYEBROW TRIMMER

BACKGROUND OF THE INVENTION

Heretofore it has been customary for ladies who desire to trim and shape their eyebrows, to do so by grasping selected eyebrows with tweezers and pulling them out. In this way they can pull out whatever hairs they consider as not being in the area where they desire to have hair, and they completely remove the hair from areas where they do not wish to have hair growing.

This practice of grasping and pulling out the hairs they wish to get rid of is painful and difficult because they develop an apprehension to the pulling of the hairs and on occasion they flinch during the process of attempting to shape the brows as they would like them to appear.

Many ladies have attempted to use a man's safety razor to shape and trim their eyebrows. These efforts have not been successful because the blade is too large and in instances where the edges of the blade were not protected by suitable guards the edge of the blade digs into the skin and cuts the brow resulting in a flow of blood which is distressing and generally interrupts the eyebrow trimming operation.

DESCRIPTION OF THE PRIOR ART

The principle prior art in the field of developing an eyebrow trimmer has been the man's safety razor. These units have large blades with pointed edges, and as a result it has been impossible to shape and trim the eyebrows with the degree of accuracy that is required because the lady's eyebrows must be carefully arched and trimmed, and the eyebrows for both eyes must be shaped and trimmed in precisely the same manner. Also, with many men's safety razors there are no guards at the ends of the blades, and that causes problems of nicking and cutting the skin in the area of the eyebrows which results in frustrations.

SUMMARY OF THE INVENTION

A narrow razor blade is mounted between front and rear razor head guards in such a manner that the cutting edge of the blade is in line with the upper surfaces of the front and rear guards so as to protect the user from serious injury by having an exposed cutting edge sticking up in such a manner that the skin would be cut.

The front and rear guards which are on opposite sides of the razor blade stretch and pull the skin in the area between them so that the razor blade is able to slice off a single hair or a few hairs at a time to facilitate the desired arching, shaping and trimming of the eyebrows.

The edges of the razor blade are curved at the corners to protect the participants from the spearing action that results if the skin and flesh are exposed to the sharp corners of razor blades.

BRIEF DESCRIPTION OF THE DRAWINGS

Referring now to the drawings wherein similar reference characters refer to similar parts throughout the several views.

DESCRIPTION OF THE PREFERRED EMBODIMENT

Figure 1:
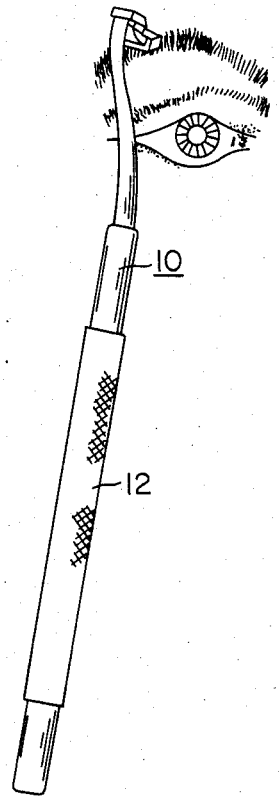
FIG. 1 is an elevational view of an eyebrow trimmer embodying the present invention.
Figure 2:
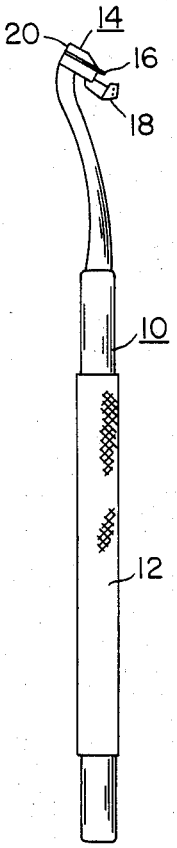
FIG. 2 is a side elevational view of the eyebrow trimmer showing a miniature razor blade in relation to the front and rear guard members.

Referring now to the drawings an eyebrow shaper and trimmer is mounted on a handle 10 having a textured area 12 for easy gripping and manipulation of the device. It has been found that an overall length of the device of approximately $5\frac{1}{4}''$ is desirable for easy manipulation and use.

Figure 3:
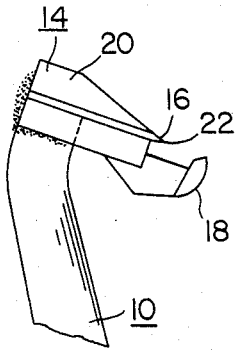
FIG. 3 is an enlarged side elevational view of the head showing more clearly the relation of the guard members to the blade.
Figure 7:
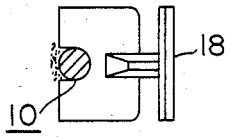
FIG. 7 is a part sectional view showing the bottom of the blade support member shown in FIG. 6.
Figure 4:
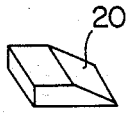
FIG. 4 is a perspective view taken from the upper left corner of the back safety guard.

The head 14 of the shaping and trimming device consists essentially of three principle elements shown more clearly in FIG. 3 which is an enlarged view of the head. The three elements are the blade 16, the front razor head guard 18, and the back razor head and safety guard 20. I have found that a razor blade of approximately 3/16 " to $\frac{1}{4}''$ in width with rounded corners to guard against accidental injury provides a desirable unit.

Figure 5:
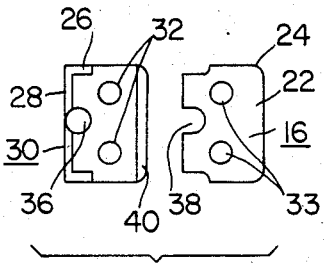
FIG. 5 is an exploded view showing the bottom of the blade holder of FIG. 4 and the blade shown in separated relation.
Figure 6:
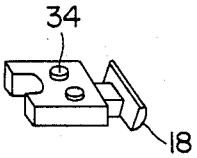
FIG. 6 is a perspective view showing the front guard member and the blade support member.

Referring to FIG. 5, attention is directed to the fact that the blade 16 is shown as depicted on a larger scale. The blade 16 has a narrow front razor's edge 22, and sharpened rounded corners 24 to permit cutting hair at the corners. The edges of the blade 16 at the rear of the blade are reduced in width to permit the rear edge of the blade 16 to be positioned between spaced slightly raised side surfaces 26, and in front of a rear raised surface 28 of a blade holder 30. The blade holder 30 and the blade 16 have dowel locator holes 32 which are adapted to align to receive dowel locators 34. The back razor head and safety guard 20 have apertures in the bottom surface 32 thereof to align with the apertures 33 in the blade 16 to permit the dowel locators 34 to secure all three members together.

The blade holder 30 has an aperture 36 with which a cutout section 38 of the blade 16 aligns to receive the end of the handle 10 to secure the head 14 to the handle by a suitable adhesive.

The front edge of the blade holder 30 has an area 40 having a slight elevation to cant slightly upwardly the front razor's edge 22.

I claim:

1. An eyebrow shaper and trimmer comprising a narrow razor blade having a cutting edge, a front safety guard projecting forwardly in front of the razor blade, a rear safety guard positioned above and angularly inclined relative to the cutting edge of the razor blade, the razor blade being cradled between the front and rear safety guards and operable to engage the skin when the skin is depressed and stretched between the front and rear guards, a handle secured to the rear guard, a razor blade holder having slightly raised rear and side surfaces, the razor blade having contoured side and rear surfaces to position the razor blade in the holder, the rear safety guard being positioned to overlie the razor blade and the razor blade holder, aligned apertures in the rear safety guard, dowel pins projecting through the aligned apertures to hold the elements in assembled relation, the razor blade holder and the razor blade having aligned apertures therethrough and an aperture in the rear safety guard for the reception of the handle.

2. The invention defined in claim 1 wherein the blade holder has an aperture adjacent its rear section approximately at the middle of the raised rear surface, and the rear edge of the blade has a cutout apertured section to align with the forward edge of the aperture in the blade holder, and a handle projecting through the apertured blade holder and the apertured section adjacent the rear edge of the blade, and an adhesive securing the handle to the blade holder and the razor blade.

* * * * *